United States Patent [19]

Golay et al.

[11] Patent Number: 4,831,934

[45] Date of Patent: May 23, 1989

[54] FUSE FOR AN ELECTRIC FIRING PROJECTILE

[75] Inventors: Jean-Pierre Golay, Viry, France; Pierre L. Gabnebin, Meyrin, Switzerland

[73] Assignee: Mefina S.A., Fribourg, Switzerland

[21] Appl. No.: 101,299

[22] PCT Filed: Nov. 21, 1986

[86] PCT No.: PCT/CH86/00160

§ 371 Date: Aug. 20, 1987

§ 102(e) Date: Aug. 20, 1987

[87] PCT Pub. No.: WO87/03953

PCT Pub. Date: Jul. 2, 1987

[30] Foreign Application Priority Data

Dec. 23, 1985 [CH] Switzerland ..... 5507/85

[51] Int. Cl.[4] ..... F42C 11/04

[52] U.S. Cl. ..... 102/209; 102/216

[58] Field of Search ..... 102/207, 209, 216, 247, 102/262

[56] References Cited

U.S. PATENT DOCUMENTS

| | | | |
|---|---|---|---|
| 2,498,040 | 2/1950 | Jordan et al. | 102/262 |
| 2,966,857 | 1/1961 | Toomey | 102/209 |
| 3,119,335 | 1/1964 | Wyser | 102/209 |
| 4,316,414 | 2/1982 | Hermanson | 102/247 |
| 4,345,124 | 8/1982 | Abbin et al. | 102/262 |

FOREIGN PATENT DOCUMENTS

| | | |
|---|---|---|
| 1140842 | 12/1962 | Fed. Rep. of Germany . |
| 314554 | 7/1956 | Switzerland . |

*Primary Examiner*—Deborah L. Kyle
*Assistant Examiner*—Richard W. Wendtland
*Attorney, Agent, or Firm*—Young & Thompson

[57] ABSTRACT

The fuse comprises an electric generator (2) consisting of a magnetic core (3) able to move in a winding (4) at the moment of the firing of the shot to provide a pulse for charging the condenser (C) intended to ignite the primer (6). In order to improve the resistance to shocks other than that of the firing of the shot, the displacement of core (3) can only take place after perforation of a small metal plate (17) by one end (16) of a rod, the other end (20) of which must be stricken by a mass (23) moving against the action of a spring (20) at the firing of the shot.

5 Claims, 1 Drawing Sheet

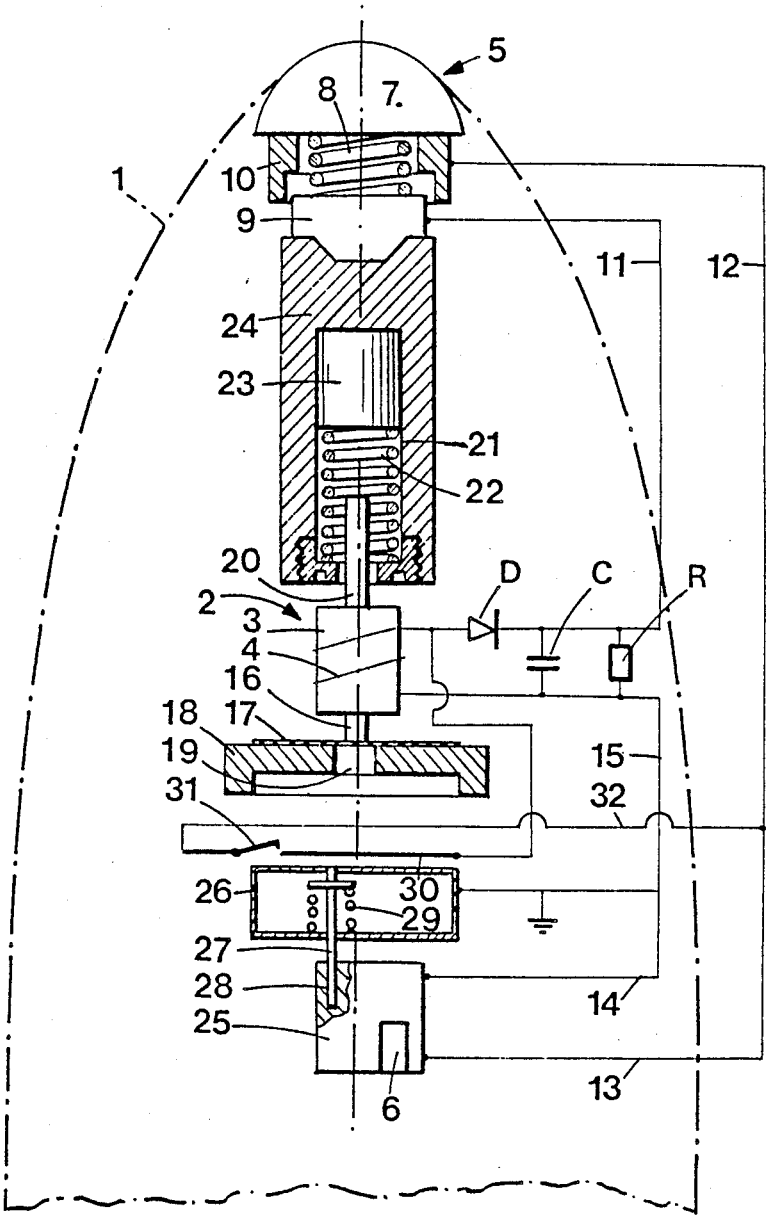
5
8
7
1
10
9
11
12
24
23
21
22
20
D
C
R
2
3
4
16
18
17
19
15
31
32
26
30
29
27
28
14
25
13
6

FUSE FOR AN ELECTRIC FIRING PROJECTILE

BACKGROUND OF THE INVENTION

The present invention relates to a fuse for an electric firing projectile, comprising a circuit with an electric primer, a generator operating by inertia to supply under the accleration effect of the firing of the shot a charge to a capacitor intended to provide the energy for firing the electric primer by way of a firing contactor, the generator comprising a mobile magnetic core which is part of a magnetic circuit associated with a winding, the core being intended to move relative to the circuit to induce in the winding a current for charging the capacitor, the displacement of the core being prevented before the firing of the shot by a security member intended to be deformed when the generator is in operation.

SUMMARY OF THE INVENTION

A fuse of this type is described for example in Swiss Patent No. 314.554.

The present invention aims at rendering these fuses safer, in particular, at rendering them able to withstand relatively strong impacts that may occur during manipulation, without the danger of operating the generator.

For this purpose, the object of the present invention is a fuse characterized in that it comprises a mass which is able to move axially in the fuse but which is retained in an initial position by a spring, the mass being disposed so as to move against the action of the spring under the effect of the acceleration of the projectile at the firing of the shot, the mass cooperating with the mobile core after having executed a dead stroke and stocked an energy which contributes to the deformation of the security member to make it possible for the operation of the generator.

BRIEF DESCRIPTION OF THE DRAWING

The single FIGURE of the attached drawing shows diagrammatically and by way of example one embodiment of the fuse which is the object of the invention.

DETAILED DESCRIPTION

This fuse is intended to be mounted in a projectile, the front part of which is represented by the chain-dotted line 1. The fuse comprises an electric generator 2 consisting of a magnetic core 3 disposed inside a winding 4. The core 3 is intended to move rapidly towards the rear of the projectile at the moment of the shooting the projectile so as to induce a current in the winding 4 for charging a capacitor C by way of a diode D, the latter preventing then the discharge of the capacitor into the winding 4.

After being charged, the capacitor C becomes the power supply for the firing circuit. This circuit comprises an impact contactor 5 to ensure the firing of an electric primer 6. The contactor 5 comprises a mobile part 7, disposed right at the front of the projectile and subjected to the action of a spring 8 which keeps it away from a contact block 9. At the moment of impact, the mobile part 7 is displaced towards the rear of the projectile against the action of spring 8, so that its conducting part 10 touches the contact block 9. The charge of the capacitor C is then applied to the primer 6 by way of conductors 11 to 15.

In order to prevent an easy displacement of core 3, the latter is extended towards the rear of the projectile by a rod 16 which abuts on a thin metal plate 17 lying on a support 18 provided with a central opening 19. Therefore, in order to move towards the rear of the projectile, core 3 must exert a bearing force strong enough to pierce plate 17. The front part of core 3 is provided with an axial rod 20 which is engaged inside a cylinder 21 containing a spring 22 and an inertial mass 23. This cylinder 21 is disposed in a part 24 which is solid with the fuse assembly.

When the shot is fired, the mass 23 is displaced under the effect of its inertia against the action of spring 22 and strikes rod 20 with an energy large enough to make it possible for rod 16 to pierce plate 17. Core 3 is then displaced towards the rear of the projectile by the combined effects of the impact brought about by mass 23 and of its own inertia, by reason of the acceleration of the projectile.

In fact, in the event of a fall of the projectile from the platform of a truck onto very hard ground, the duration of the impact is too short to make it possible for mass 23 to entirely compress spring 22 and strike rod 20.

Primer 6 is mounted on a rotor 25 subjected to the action of a spring not shown in the figure and held in rotation against the action of the spring by a timing device 26 comprising a rod 27 engaged in a bore 28 of rotor 25 and urged by a spring 29. The mechanism of timer 26 is not described in detail since this type of mechanical timer is well known.

The timing device 26 is sensitive to the starting acceleration of the projectile and releases rod 27 just after the firing of the shot. The rod 27 disengages rotor 25 to allow primer 6 to be placed in its firing position.

Before releasing rotor 25, the upper end of rod 27 pushes on a contact blade 30 and at the same time sets it at ground potential. While moving, blade 30 touches a contact member 31, grounding it momentarily. If, owing to some defect or accident, the impact contactor 7 were to be closed, the capacitor would then be discharged via a circuit comprising conductor 11, the impact contactor, conductor 12 and a conductor 32 leading to contact member 31.

After having touched the contact member 31, the blade 30 continues on its movement and remains in contact with rod 27, so that the output of winding 4 leading to diode D is grounded. This winding is thus short-circuited and this prevents any recharging of the capacitor C by the generator 2, in the event that the fuse fails to work, owing for instance to its touching on a very soft ground, such as snow.

It is to be noted that in case of misfire the fuse will become inoperative after a time delay which may be of the order of a few minutes after impact, and this owing to a leak resistor R which is connected to the terminals of capacitor C.

It is of course possible to envisage many other variants of the device described and it goes without saying that the security device which opposes the displacement of core 3 could be realized by any piece demanding a well-defined force in order to be displaced or deformed by the core at the firing of the shot. Likewise, the combined work of the inertia mass 23 and the core 3 could be obtained by other means, in particular by a direct cooperation between mass 23 and core 3 or still by a rod, such as rod 20, solid with mass 23 and the free end of which would strike the core 3.

We claim:

1. A fuse for an electric firing projectile, comprising a circuit with an electric primer, a generator operating by inertia to supply under the acceleration effect of the firing of the shot a charge to a capacitor intended to provide the energy for firing said electric primer by way of a firing contactor, said generator comprising a mobile magnetic core which is part of a magnetic circuit associated with a winding, the remainder of said magnetic circuit being fixed relative to said fuse, said core being intended to move relative to said circuit to induce in the winding a current for charging said capacitor, the displacement of the core being prevented before the firing of the shot by a security member intended to be deformed when the generator is in operation, the improvement which comprises (a) a mass arranged for axial movement within said fuse; and (b) a spring arranged within said fuse for retaining said mass in an initial position, said mass moving against the biasing force of said spring upon acceleration of the projectile at the firing of a shot, said mass striking said mobile magnetic core after having executed a dead stroke and having stored energy which contributes to the deformation of said security member to enable operation of said generator.

2. A fuse as defined in claim 1, wherein said mass is located in a cylinder which also contains said spring, said spring comprising a compression coil-spring, and further wherein the mobile core of the generator is provided with a rod which penetrates inside said spring located in said cylinder.

3. A fuse as defined in claim 1, wherein said fuse comprises a timing device activated upon the shooting of the projectile and intended to prevent the firing of the projectile for a given time after said shooting, said timing device, when activated, being adapted to operate first the closing and then the opening of first contact means, said first contact means being connected with a circuit branch which comprises said capacitor and said firing contactor, connected in series.

4. A fuse as defined in claim 3, wherein said timing device, at the end of its operation, activates second contact means to short-circuit the winding of the generator.

5. A fuse as defined in claim 1, wherein said capacitor of the generator is shunted by a leak resistor.

* * * * *